US007318500B2

(12) United States Patent
Rekinen et al.

(10) Patent No.: US 7,318,500 B2
(45) Date of Patent: Jan. 15, 2008

(54) METHOD OF INTEGRATING TELECOMMUNICATION SERVICES WITH SERVICES PERFORMED FOR ONE OR MORE AUTOMATIC DEVICES

(75) Inventors: Tero Rekinen, Helsinki (FI); Veikko Mattson, Hyvinkää (FI)

(73) Assignee: Kone Corporation, Helsinki (FI)

( * ) Notice: Subject to any disclaimer, the term of this patent is extended or adjusted under 35 U.S.C. 154(b) by 303 days.

(21) Appl. No.: 10/724,690

(22) Filed: Dec. 2, 2003

(65) Prior Publication Data

US 2004/0159498 A1 Aug. 19, 2004

(30) Foreign Application Priority Data

Dec. 3, 2002 (FI) ..... 20022133

(51) Int. Cl.
*B66B 1/34* (2006.01)

(52) U.S. Cl. ..... 187/391; 187/414; 705/34

(58) Field of Classification Search ..... 187/391–399, 187/316, 317, 247, 414, 380–388, 248; 705/1, 705/9, 34, 39

See application file for complete search history.

(56) References Cited

U.S. PATENT DOCUMENTS 6,578,675 B2 * 6/2003 Wilson et al. ..... 187/391
2002/0173970 A1 * 11/2002 Hamada ..... 705/1
2003/0000798 A1 * 1/2003 Williams et al. ..... 198/321

* cited by examiner

*Primary Examiner*—Jonathan Salata
(74) *Attorney, Agent, or Firm*—Birch, Stewart, Kolasch & Birch, LLP

(57) ABSTRACT

The present invention relates to a method for including the telecommunication connections needed in the use of remote monitoring of automatically operated equipment in contracts between a company maintaining said equipment and a client owning said equipment. According to the method of the invention, the above-mentioned company takes care of the administration of the telecommunication connections, including the acquisition and opening of the aforesaid telecommunication connections as well as the invoicing concerning them.

10 Claims, 1 Drawing Sheet

METHOD OF INTEGRATING TELECOMMUNICATION SERVICES WITH SERVICES PERFORMED FOR ONE OR MORE AUTOMATIC DEVICES

This nonprovisional application claims priority under 35 U.S.C. § 119(a) on Patent Application No. 20022133 filed in FINLAND on Dec. 3, 2002, the entire contents of which are hereby incorporated by reference.

BACKGROUND OF THE INVENTION

The present invention relates to a method as defined in the preamble of claim 1 for including the telecommunication arising from remote monitoring of elevators and/or escalators and/or automatic doors and/or from the use of an emergency telephone in the contracts between a company maintaining the elevators and/or escalators and/or automatic doors and a client using the elevators and/or escalators and/or automatic doors.

In an elevator directive comprising provisions concerning elevators, it is stated that every elevator installed shall be provided with a two-way voice connection and alarm buttons on the top of the elevator for installers for emergency situations. Therefore, an emergency telephone is a necessity in elevators to improve the safety of elevator passengers.

Remote monitoring of elevators again refers to a technique of monitoring the state and condition of elevators from a distance by utilizing a telecommunication connection.

Remote monitoring refers to procedures generally used to observe the state and condition of a device by measuring parameters whose changes reflect changes in the state and condition of the device. In remote monitoring in general, the state and condition of the device is monitored regularly. When a change occurs in the state and condition, a more detailed fault diagnosis can be performed. Fault diagnosing again refers to procedures used to detect and identify a fault and locate the cause of the fault. The most important function of a fault diagnostics system is to detect a fault reliably and definitely as early as possible.

Sometimes a diagnostics system is programmed to produce a suggestion of how the fault detected could be eliminated. In this way, it is possible to implement the task of determining the need for preventive maintenance of elevators.

In remote monitoring of the state and condition of elevators, the elevators themselves give warnings of faults to be expected. Thus, the wear of components can be detected before they fail completely. Therefore, it is possible to set a fixed target value for the failure frequency of elevators beforehand to measure the reliability and quality of the elevators. For example, the target set for an elevator may be only one fault of a nature interrupting the passenger's elevator journey per year.

Automatic doors generally refers to automatically operated and controllable doors in buildings. Several different types of such automatic doors are known, such as e.g. upward acting doors, folding doors, fireproof doors, revolving doors, sliding doors, rolling doors, turning doors, etc.

The maintenance services for automatic doors in buildings cover preventive maintenance and round-the-clock emergency duty and door repair and modernization services. Through a maintenance contract, more effective maintenance of automatic doors is achieved, because it is thus possible to service all automatic doors in the building at the same time regardless of the type or make of the doors. Moreover, preventive maintenance of automatic doors improves the usability of the doors, increases their service life and reduces the need for repairs. In this way, cost savings are achieved. Preventive maintenance also improves the operational safety of automatic doors. The same applies in the case of elevators and escalators, too.

At present, the emergency telephone and the remote monitoring system use the same telecommunication connection, which according to the present state of the art is preferably either a wired telephone connection or a wireless GSM connection. This telecommunication connection is owned by the client, who pays the bills for the connection to the operator. In the case of a GSM telephone, this leads to problems in the management of SIM cards. To allow an installed device to be put into service immediately, the installer of the telecommunication connection must always have the SIM card with him at the time of installation. There may sometimes be difficulties in having a SIM card owned and managed by a client always brought in time to the elevator installation site. In addition, the company installing the elevator and maintaining it after installation does not necessarily know beforehand which operator's card the client has acquired.

As is known, today the client is invoiced for the services covered by a contract of maintenance of an elevator and/or escalator and/or automatic door by the company responsible for the maintenance. In addition, the client is also invoiced by the teleoperator for their telecommunication connection, which is used to transfer both the remote monitoring communication and emergency calls. Problems are encountered in the management of invoices by a large-scale manager, because a large-scale manager has many maintenance contracts and therefore significant numbers of invoices are generated.

The main problem at present appears to be the fact that the client has to pay an invoice both to the operator and to the company maintaining the elevators and/or escalators and/or automatic doors.

The object of the present invention is to overcome the drawbacks and problems encountered in the above-mentioned prior-art solutions.

SUMMARY OF THE INVENTION

In definite terms, the method of the invention for including the telecommunication arising from remote monitoring of elevators and/or escalators and/or automatic doors and/or from the use of an emergency telephone in the contracts between a company maintaining the elevators and/or escalators and/or automatic doors and a client using the elevators and/or escalators and/or automatic doors is characterized by what is disclosed in the characterization part of claim 1. The features of certain preferred embodiments of the invention are disclosed in the subclaims.

DETAILED DESCRIPTION OF THE INVENTION

Figure 1:
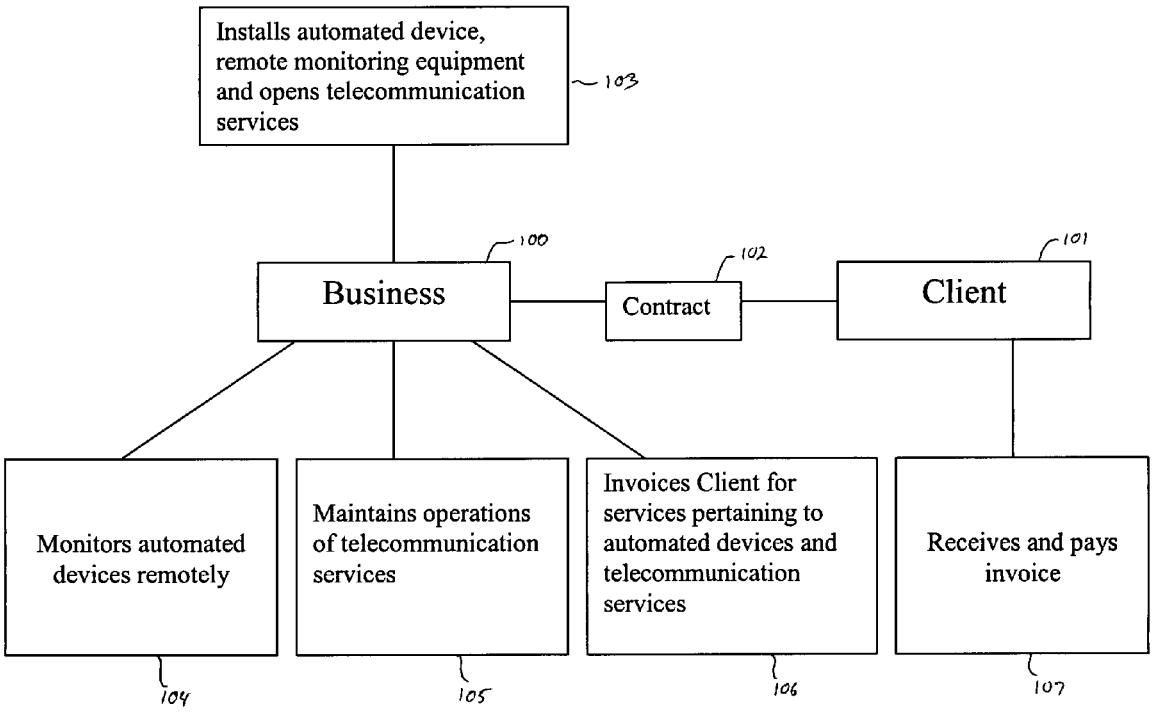
FIG. 1 is a chart illustrating an embodiment of the present invention.

By the method of the invention, several significant advantages over prior art are achieved.

In a preferred case, the method of the invention allows the client to avoid being invoiced by the operator and having to acquire a telecommunication line.

A further advantage achieved by the invention is that it also makes it possible to open several telecommunication connections when the subscriber lines of the same elevator maintenance company are used. Thus, the installer who opens the subscriber connections has a number of SIM cards with him, from which he can open connections and/or telephones while installing elevator remote monitoring equipment.

The present invention also provides an advantage in that the company maintaining the elevators is able to ensure that the GSM field is operative in the elevator, because the network operator is known and the installer has the SIM cards with him on the site of installation. In this way, the client buying the elevator is guaranteed that the elevator remote monitoring system and the telecommunication connection for emergency calls will be functional.

In addition, with the present invention, the client preferably only receives an invoice relating to elevator maintenance, while the invoicing concerning remote monitoring and emergency calls is taken care of by the elevator maintenance company on behalf of the client.

A further advantage achieved by the method of the invention is that the elevator maintenance company can negotiate global invoicing agreements with teleoperators and thus obtain prices for elevator remote monitoring and emergency call connections that are considerably lower than the listed tariffs, especially for GSM connections. As the volume of telephone traffic in elevator systems is generally small and mainly occurs at night time, operators are interested in having a possibility to invoice their clients for elevator telecommunication at a fixed monthly rate. It is advantageous to have elevator telecommunication carried out at night time because that is when telecommunication networks are normally underutilized. The elevator maintenance company can use this possibility as a marketing argument and wins a part of the cost savings for itself. This benefits both the client and the elevator maintenance company. Thus, the price paid by the client for the service as a whole, comprising elevator maintenance and telecommunication, is reduced while the profit margin of the elevator maintenance company increases.

An additional advantage is that during construction-time use of the elevator there will be no problems even if the builder and the owner of the building are not the same, because the telecommunication line is administered by the company installing the elevator and maintaining the elevator after installation. Therefore, the elevator installer can open the telecommunication connection of the elevator after the installation has been completed.

The present invention relates mainly to the use of wireless telecommunication in elevator emergency calls and remote monitoring data transfer. A further relevant area is data communication over various network connections installed in elevators. Such network connections include e.g. WLAN, LAN, Ethernet, etc. It is also to be noted that wireless communication is today generally more expensive than wired communication.

The present invention concerns a method for including the telecommunication connections needed in the use of remote monitoring of elevators and/or escalators and/or automatic doors and/or an emergency telephone in the contracts between a company maintaining elevators and/or escalators and/or automatic doors and a client owning elevators and/or escalators and/or automatic doors. According to the most preferred embodiment of the present invention, the aforesaid company takes care of the administration of the telecommunication connections, comprising the acquisition and opening of the aforesaid telecommunication connections as well as invoicing concerning same.

FIG. 1 illustrates an embodiment of the present invention in which a business (company) 100 contracts 102 with client 101 to open telecommunication connections and install monitoring devices used in monitoring through telecommunication services 103 and also the monitoring and maintenance of these devices and services 104, 105. The business further performs the payment for these services to a third party, if necessary, and invoices the client with a bill 106. The bill can be a single bill for all services and work rendered. The client can then pay the invoice 107.

According to another embodiment of the method of the present invention, the aforesaid company takes care of the costs accumulated from aforesaid telecommunication, incorporating the aforesaid costs either completely or partly in the price of a maintenance contract between the aforesaid client and the aforesaid company.

Likewise, according to another embodiment of the present invention, fixed monthly costs and the costs of opening the connection as well as costs varying according to the volume of telecommunication traffic are included in the costs accumulated from aforesaid telecommunication.

According to the present invention, the client is preferably invoiced for the costs accumulated from telecommunication either as a fixed sum or in dependence of the actual costs.

Further, according to another embodiment of the invention, the aforesaid client is invoiced for the aforesaid costs accumulated from telecommunication in connection with the contract concerning maintenance of elevators and/or escalators and/or automatic doors.

Most of the remote monitoring telecommunication is preferably scheduled to occur at night time.

According to a preferred embodiment of the invention, both wireless and wired telecommunication connections are used for the remote monitoring telecommunication.

It is also possible in the future that the method of the invention can be applied in other equipment using telecommunication for remote monitoring. In the future, such equipment could include e.g. automatically operated tractors, container hoists, forest machines, etc. In a more general sense, the invention concerns a method for including the telecommunication arising from remote monitoring of automatically operated equipment in contracts made between a company maintaining the aforesaid equipment and a client using said equipment.

In the foregoing, the invention has been described by way of example with reference to the attached drawings while different embodiments of the invention are possible in the scope of the inventive concept defined in the claims.

The invention claimed is:

1. A method of integrating a telecommunication service for use in remote monitoring of one or more automated devices, comprising:

opening telecommunication connections needed to perform remote monitoring of said automated devices using said telecommunication service;

monitoring of the one or more automated devices remotely using at least the telecommunication service;

maintaining operations of the one or more automated devices and telecommunication connections; and invoicing a client at regular time intervals, the invoice including at least fees for including the telecommunication connections, the monitoring and maintaining of the one or more automated devices, fees for using the telecommunication service.

2. The method of claim 1, wherein the costs associated with opening the telecommunication service are included in at least one of the invoices provided to the client at regular time intervals.

3. The method of claim 1, wherein the costs of the telecommunication service are provided to the client as fixed sum or is based on the actual costs associated with the usage and maintenance during a time period.

4. The method of claim 1, wherein the automated devices are one of at least an elevator, an escalator and automated door.

5. The method of claim 1, wherein a wireless connection is used for the telecommunication service.

6. The method of claim 1, wherein a wired connection is used for the telecommunication service.

7. The method of claim 1, wherein the remote monitoring is scheduled to occur at night.

8. A system of administering telecommunication services for remote monitoring of one or more automated devices, for a client, comprising:

one or more monitoring devices that are used to monitor the telecommunication devices and one or more automated device functions and operations;

wherein a network provider is established allowing connection of the monitoring devices with a control device, via the telecommunication devices, from which the control device controls the monitoring operations of the one or more automated devices and telecommunication devices and the network connection.

9. The system of claim 8, wherein the administration of the telecommunication services, devices, one or more automated devices, monitoring devices, and network provider are billed to the client on a single bill.

10. The system of claim 8, wherein the automated devices are one of at least an elevator, an escalator and automated door.

* * * * *